United States Patent [19]

Taylor et al.

[11] Patent Number: 4,511,373

[45] Date of Patent: Apr. 16, 1985

[54] FLUORINATED DIAMOND PARTICLES BONDED IN A FILLED FLUOROCARBON RESIN MATRIX

[75] Inventors: Gene W. Taylor, Los Alamos; Herman E. Roybal, Santa Fe, both of N. Mex.

[73] Assignee: The United States of America as represented by the United States Department of Energy, Washington, D.C.

[21] Appl. No.: 551,528

[22] Filed: Nov. 14, 1983

[51] Int. Cl.[3] ..... C09K 3/14

[52] U.S. Cl. ..... 51/298; 51/309

[58] Field of Search ..... 51/298, 309

[56] References Cited

U.S. PATENT DOCUMENTS

| | | | |
|---|---|---|---|
| 3,551,125 | 12/1970 | Hallewell et al. | 51/298 |
| 3,664,819 | 5/1972 | Sioui et al. | 51/298 |
| 3,711,595 | 1/1973 | Margave et al. | 423/446 |
| 3,902,873 | 9/1975 | Hughes | 51/298 |
| 4,343,628 | 8/1982 | Taylor | 51/298 |

*Primary Examiner*—Paul Lieberman

*Attorney, Agent, or Firm*—Samuel M. Freund; Paul D. Gaetjens; Judson R. Hightower

[57] ABSTRACT

A method of producing fluorinated diamond particles bonded in a filled fluorocarbon resin matrix. Simple hot pressing techniques permit the formation of such matrices from which diamond impregnated grinding tools and other articles of manufacture can be produced. Teflon fluorocarbon resins filled with $Al_2O_3$ yield grinding tools with substantially improved work-to-wear ratios over grinding wheels known in the art.

23 Claims, No Drawings

FLUORINATED DIAMOND PARTICLES BONDED IN A FILLED FLUOROCARBON RESIN MATRIX

This invention is the result of a contract with the Department of Energy (Contract No. W-7405-ENG-36).

BACKGROUND OF THE INVENTION

The invention described herein relates generally to a method for bonding diamond particles in a support matrix and articles of manufacture formed therefrom. More particularly, it relates to a method of strongly bonding fluorinated diamond particles in a support matrix composed of a filled fluorocarbon resin.

Substantial progress has been made in bonding industrial diamonds in a support matrix for the manufacture of abrasive tools which can withstand high stress loadings without separation and cracking. See, e.g., U.S. Pat. No. 4,343,628 issued to Gene W. Taylor on Aug. 10, 1982, the teachings of which are hereby incorporated by reference herein. However, such abrasive tools have been found to have unsatisfactory work-to-wear ratios. That is, the wear on a grinding tool is substantial with respect to the amount of material removed from the work piece. Extending the useful life of support matrix bonded diamond abrasive tools would therefore have industrial significance.

SUMMARY OF THE INVENTION

Accordingly, it is an object of the present invention to provide a method for the improved bonding of diamonds in a support matrix.

Another object of our invention is to provide improved articles of manufacture produced from diamonds bonded in a support matrix.

A further object of the instant invention is to provide a method for bonding diamonds in a support matrix which results in an abrasive material which is less susceptible to cracking and separating under heavy stress loads, from which the diamond material distributed therein is less susceptible to pulling free under such loads, and which has an improved work-to-wear ratio when the abrasive material is applied to a hard substance to be worked.

Still another object of the invention is to provide a method for the improved bonding of diamonds in a support matrix by standard hot pressing techniques.

To achieve the foregoing and other objects, and in accordance with the purposes of the present invention, as embodied and broadly described herein, the method of this invention includes the steps of fluorinating the surface of the diamond particles, blending the fluorinated diamond particles with a fluorocarbon resin and a filler material, and hot pressing the mixture thereby produced to form a continuous matrix of filled fluorocarbon resin to which the fluorinated diamond particles are bonded. Preferably, the fluorocarbon resin includes a copolymer of tetrafluoroethylene and hexafluoropropylene. It is also preferred that the filler material be $Al_2O_3$, $AlB_2$ or $B_4C$, or mixtures thereof, although it is expected that other substances will be similarly effective.

In a further aspect of the present invention, in accordance with its objects and purposes, the article of manufacture hereof includes fluorinated diamond particles bonded in filled fluorocarbon resin. It is preferred that the fluorocarbon resin include a copolymer of tetrafluoroethylene and hexafluoropropylene. Preferably also, the filler material includes $Al_2O_3$, $B_4C$, or $AlB_2$, or mixtures thereof. In a preferred embodiment of our invention a mixture formed by blending the fluorinated diamond particles, the fluorocarbon resin and the filler material is hot pressed forming a support matrix. It is also preferred that the support matrix be bonded to a chosen metal such as soft aluminum when the article of manufacture is used as a grinding tool.

Diamond impregnated abrasive tools hot pressed from the above-described mixtures have substantially improved work-to-wear ratios over the fluorocarbon resin bonded tools known in the art while retaining all of the desirable properties thereof. That is, the articles of manufacture are capable of undergoing high stress loadings without separating or cracking. Our invention also permits well-known fluorocarbon resins of the type sold under the tradename of TEFLON to be used as the binding support matrix.

DETAILED DESCRIPTION OF THE INVENTION

Turning now to a description of the preferred embodiments of the subject invention, it is known in the art that diamond surfaces which have been cleaned by low energy (600 V) $Ar^+$ ion bombardment can readily be saturated with chemisorbed fluorine by exposing the surfaces to F atoms generated by microwave-discharged $SF_6$ vapor at low pressure ($\sim 10^{-1}$ torr). A monolayer of covalently bonded fluoride compounds form within a few minutes. These compounds contain $\equiv CF$, $=CF_2$, and $-CF_3$ groups. After approximately 20 minutes of exposure to the conditions noted, these groups were found to be present in the following percentages, respectively: 61, 30, and 9%.

A fluorinated diamond surface formed in this manner has certain of the characteristics of the fluorocarbon resins sold under the trademark TEFLON by E. I. du Pont de Nemours and Co. Because of this fact, fluorinated diamond particles are more readily bonded to a polymeric material than are nonfluorinated diamond particles. This is especially true if the polymeric material is itself fluorinated. Therefore, fluorocarbon resins such as TEFLON are particularly well-suited for use in the practice of the present invention.

The preferred fluorocarbon resin is TEFLON FEP which is a copolymer of tetrafluoroethylene ($CF_2{=}CF_2$) and hexafluoropropylene ($CF_2{=}CF{-}CF_3$) having the general chain formula $$[-CF_2-CF_2-CF_2-CF_2-CF_2-\underset{\substack{|\\ CF_3}}{CF}-CF_2-CF_2-]_n$$

It will be apparent to one skilled in the art that the ratio of tetrafluoroethylene to hexafluoropropylene may be varied in the copolymer. However, the preferred ratio is that of the resin sold as TEFLON 856-200 FEP.

Filler materials investigated include $Al_2O_3$, $AlB_2$ and $B_4C$. $Al_2O_3$ produced the most substantial improvement in grinding tool performance, but the addition of $AlB_2$ or $B_4C$ produced definite improvement as well. It will be apparent to one skilled in the art that other filler materials could be found which would improve the characteristics of unfilled fluorocarbon resin bonded fluorinated diamond abrasive tools.

A typical filled, fluorocarbon resin bonded fluorinated diamond abrasive tools is fabricated as described hereinbelow. Industrial diamonds of various grit sizes are fluorinated according to the method described in above-referenced U.S. Pat. No. 4,343,628. An aqueous dispersion or emulsion of TEFLON 856-200 FEP is mixed with the fluorinated diamond particles and the filler material to form a paste. The amount of TEFLON 856-200 FEP is not critical, provided only that it is present in an amount sufficient to act as an effective binder for the diamond particles and filler material when hot pressed. Amounts ranging from about 22 weight percent to about 35 weight percent have been used. The amount of filler material is similarly not critical. Amounts ranging from 20 weight percent to 40 weight percent have been successfully employed. An amount of toluene sufficient to "break" the emulsion is then stirred into the paste. Typically, a few milliliters is sufficient for this purpose. The mixture is then slurried with an excess of acetone until foaming ceases. The solids are allowed to settle and the liquid is decanted. The wet solid mixture is dried under vacuum at at least 150° C. for 12 hours. Generally, about 250° C. is a preferred temperature. This serves to volatilize and remove the wetting agents used in forming the TEFLON 856-200 FEP emulsion as well as the water in which the emulsion is formed. The small beads of TEFLON 856-200 FEP which were dispersed in the emulsion adhere to the fluorinated diamond particles by electrostatic attraction. The dried mixture of fluorocarbon resin, fluorinated diamond particles, and filler material is the diamond molding powder from which abrasive tools can be fashioned by conventional hot pressing hardened steel die techniques to form a matrix in a desired shape of filled fluorocarbon resin in which the fluorinated diamond particles are substantially uniformly dispersed and bonded. It will be apparent to one skilled in the art that dry mixing the component materials will yield comparable results.

In the manufacture of a grinding wheel, for example, in accordance with the invention, a dead-soft aluminum cylinder was centered in a cylindrical hardened steel die of a desired diameter, and the dried diamond molding powder was poured around the aluminum cylinder. The powder and cylinder were then pressurized to approximately 20,000 psi at about 325° C. and then cooled under pressure. Under these conditions, the TEFLON 856-200 FEP melted to form a continuous matrix in which the fluorinated diamond particles were strongly bonded. It should be mentioned that the pressurized diamond molding powder does not have to remain hot for a significant time period. The cooling process may be rapid and may commence essentially immediately after the diamond molding powder is brought up to the desired temperature and pressure. Simultaneously, the aluminum cylinder was deformed into a hub having the matrix strongly bonded to its outer diameter. The aluminum hub is then drilled out at its center to form a grinding wheel which may readily be mounted to any appropriate grinder.

The temperature and pressure given in the foregoing description are not critical. Thus, any temperature in the range between about 300° C. and 400° C. may be used. Working near the upper limit of this range yields better grinding wheels for TEFLON 856-200 FEP. At higher temperatures, however, the TEFLON 856-200 FEP began to seriously degrade. The essential limitation on the temperature employed is that it be sufficient to heat bond the beads of fluorocarbon to each other, to the fluorinated diamond particles and to the filler material but insufficient to degrade the resulting matrix. The optimal temperature will of course depend on the fluorocarbon resin utilized. Similarly, the pressure required must only be sufficient to adequately compact the powder and deform the central cylinder so as to form the desired wheel. Pressures in the range from approximately 15,000 psi to 20,000 psi have been used. The above-described method resulted in diamond-loaded disk suitable as circular grinding wheels. The bond between the filled, diamond impregnated fluorocarbon resin and the aluminum substrate has endured the centrifugal forces associated with about 17,000 rpm on a radius of 1.25 in.

To illustrate the method of this invention, the following examples are present.

EXAMPLE I

A diamond/$Al_2O_3$ wheel with 55.1% of 170–230 mesh diamond particles fluorinated in an $SF_6$ discharge, 24.8% $Al_2O_3$ (99% theoretical density, 900 grit), and 20.2% TEFLON 856-200 FEP solid by weight was fabricated according to the above-described procedure. Test results are described in Table I. Typically, unfilled grinding wheels prepared in accordance with teachings of U.S. Pat. No. 4,343,628, referenced hereinabove, lost 0.040" from their diameters for 0.100" removed from the workpiece.

EXAMPLE II

A diamond/$Al_2O_3$ wheel with 43.8% of the 170–230 mesh diamond particles fluorinated in an $SF_6$ discharge, 36.0% $Al_2O_3$ (99% theoretical density, 900 grit), and 20.2% TEFLON 856-200 FEP solid by weight was fabricated according to the above-described procedure. Test results are described in Table II.

The addition of $B_4C$ or $AlB_2$ filler materials did not result in grinding wheels which performed as well as those in the above-described examples.

TABLE I

| Material ground | $Al_2O_3$ ceramic | $B_4C$ + FEP | Tungsten Carbide | A-2 steel |
|---|---|---|---|---|
| Planar cut | 0.101" | 0.1445" | 0.043" | 0.105" |
| Wheel wear (off diameter) | 0.000 | 0.005 | 0.001 | 0.002 |

TABLE II

| Material ground | $Al_2O_3$ ceramic | $B_4C$ + FEP | Tungsten Carbide | A-2 steel |
|---|---|---|---|---|
| Planar cut | 0.061" | 0.030 | 0.033 | 0.022 |
| Wheel wear (off diameter) | 0.000 | 0.0005 | 0.000 | 0.000 |

However, definite improvement over grinding wheels fabricated from unfilled fluorocarbon resin bonded fluorinated diamond particles was observed.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What we claim is:

1. An article of manufacture which comprises a formed, filled fluorinated resin support matrix in which fluorinated diamond particles are bonded, said filler material being selected from the group consisting of $Al_2O_3$, $B_4C$ and $AlB_2$, and comprising between about 20–40 weight percent of said filler material.

2. The article of manufacture as described in claim 1, wherein said diamond particles include diamond particles having a multiplicity of sizes, said diamond particles being distributed substantially uniformly throughout said formed support matrix.

3. The article of manufacture as described in claim 2, wherein said filled fluorocarbon resin includes a mixture of a copolymer of tetrafluoroethylene and hexafluoropropylene having the general chain formula $$[-CF_2-CF_2-CF_2-CF_2-CF_2-\underset{\underset{CF_3}{|}}{CF}-CF_2-CF_2-]_n$$

4. The article of manufacture as described in claim 3, wherein said article of manufacture comprises between approximately 20 and 35 weight % of said fluorocarbon resin.

5. The article of manufacture as described in claim 4, wherein said mixture of said copolymer of tetrafluoroethylene and hexafluoropropylene, said diamond particles, and said filler material is wet blended, dried at about 150° C. for 12 hours, pressed at between about 15,000 psi and 20,000 psi at between approximately 300° C. and 375° C., and cooled under pressure.

6. The article of manufacture as described in claim 2, wherein said filled fluorocarbon resin includes a mixture of a copolymer of tetrafluoroethylene and hexafluoropropylene and $Al_2O_3$.

7. The article of manufacture as described in claim 6, wherein said formed support matrix is bonded to a chosen metal.

8. The article of manufacture according to claim 7, wherein said chosen metal is dead-soft aluminum.

9. An abrasive composition of matter which comprises fluorinated diamond particles strongly bonded to a matrix which includes a hot-pressed mixture of a copolymer of tetrafluoroethylene and hexafluoropropylene and a filler material selected from the group consisting of $B_4C$, $Al_2O_3$ and $AlB_2$, said fluorinated diamond particles being substantially uniformly dispersed therein.

10. An abrasive grinding wheel which comprises fluorinated diamond particles strongly bonded to a matrix which includes a hot-pressed mixture of a copolymer of tetrafluoroethylene and hexafluoropropylene and an $Al_2O_3$ filler material, said fluorinated diamond-particles being substantially uniformly dispersed therein, said matrix further being strongly bonded to a metallic substrate.

11. The wheel as described in claim 9, wherein said metallic substrate is formed from aluminum metal.

12. A method for bonding diamond particles to a filled fluorocarbon resin, which comprises the steps of:

a. fluorinating the diamond particles;

b. blending the fluorinated diamond particles produced from said diamond particles fluorinating step with a fluorocarbon resin and a filler material; and c. hot pressing the mixture produced from said blending step at a temperature and pressure sufficient to form a continuous matrix of filled fluorocarbon resin to which said fluorinated diamond particles are bonded.

13. The method as described in claim 12, wherein the diamond particles to be fluorinated are diamond particles, and wherein the fluorinated diamond particles are distributed substantially uniformly throughout said continuous matrix of filled fluorocarbon resin.

14. The method according to claim 13, wherein said fluorocarbon resin includes a copolymer of tetrafluoroethylene and hexafluoropropylene having the general chain formula $$[-CF_2-CF_2-CF_2-CF_2-CF_2-\underset{\underset{CF_3}{|}}{CF}-CF_2-CF_2-]_n, \text{ and}$$

said filler material is selected from the group consisting of $Al_2O_3$, $AlB_2$ and $B_4C$.

15. A method for producing an abrasive composition of matter, which comprises the steps of:

a. fluorinating diamond particles to produce diamond particles having a fluorinated surface;

b. slurry blending an aqueous emulsion of a copolymer of tetrafluoroethylene and hexafluoropropylene with chosen amounts of $Al_2O_3$ filler material and said fluorinated diamond particles to form a mixture;

c. drying said mixture to remove substantially all liquids and volatiles, thereby forming a dried mixture; and d. hot pressing said dried mixture at a temperature and pressure sufficient to produce a substantially continuous matrix of said copolymer and said $Al_2O_3$ to which said fluorinated diamond particles are strongly bonded.

16. The method as described in claim 15, wherein said dried mixture is hot pressed at a temperature between about 300° C. and 375° C.

17. The method as described in claim 16, wherein said dried mixture is hot pressed at a pressure between approximately 15,000 psi and 20,000 psi and then cooled while under pressure.

18. The method as described in claim 16, wherein said mixture is vacuum dried at about 150° C.

19. A method for producing an abrasive composition of matter, which comprises the steps of:

a. fluorinating diamond particles to produce diamond particles having a fluorinated surface;

b. dry blending a copolymer of tetrafluoroethylene and hexafluoropropylene with chosen amounts of $Al_2O_3$ filler material and said fluorinated diamond particles to form a mixture; and c. hot pressing said mixture at a temperature and pressure sufficient to produce a substantially continuous matrix of said copolymer and said $Al_2O_3$ to which said fluorinated diamond particles are strongly bonded.

20. The method as decribed in claim 19, wherein said mixture is hot pressed at a temperature between about 300° C. and 375° C.

21. The method as described in claim 20, wherein said mixture is hot pressed at a pressure between approximately 15,000 psi and 20,000 psi, and then cooled while under pressure.

22. An abrasive composition of matter which consists essentially of a hot-pressed mixture of a copolymer of tetrafluoroethylene and hexafluoropropylene, an $Al_2O_3$ filler material and fluorinated diamond particles, whereby a substantially uniform filled fluorocarbon resin support matrix is formed in which said fluorinated diamond particles are strongly bonded.

23. An abrasive grinding wheel which consists essentially of a hot-pressed mixture of fluorinated diamond particles, a copolymer of tetrafluoroethylene and hexafluoropropylene, and an $Al_2O_3$ filler material, whereby a substantially uniform filled fluorocarbon resin support matrix is formed in which said fluorinated diamond particles are strongly bonded, said support matrix being strongly bonded to a metallic substrate.

* * * * *